US006959841B2

(12) United States Patent
Vlodek

(10) Patent No.: US 6,959,841 B2
(45) Date of Patent: Nov. 1, 2005

(54) CLOSURE WITH SELECTIVELY OPERABLE DISPENSE FEATURE

(76) Inventor: James A. Vlodek, 10950 Linn Ct., LaGrange, IL (US) 60525

( * ) Notice: Subject to any disclaimer, the term of this patent is extended or adjusted under 35 U.S.C. 154(b) by 297 days.

(21) Appl. No.: 10/602,402

(22) Filed: Jun. 23, 2003

(65) Prior Publication Data

US 2004/0011679 A1 Jan. 22, 2004

Related U.S. Application Data

(63) Continuation-in-part of application No. 10/003,158, filed on Oct. 31, 2001, now Pat. No. 6,609,612.

(60) Provisional application No. 60/244,934, filed on Nov. 1, 2000.

(51) Int. Cl.[7] ..... B67D 5/56

(52) U.S. Cl. ..... 222/129; 222/325; 222/525; 206/219; 220/521; 215/DIG. 8

(58) Field of Search ..... 222/129, 325, 222/519–525; 206/219–222; 215/DIG. 8; 220/521

(56) References Cited

U.S. PATENT DOCUMENTS

| | | | | |
|---|---|---|---|---|
| 2,824,010 | A | 2/1958 | Pedersen | |
| 3,404,811 | A | 10/1968 | Cernei | |
| 3,451,540 | A | 6/1969 | Kulischenko | |
| 3,779,372 | A | 12/1973 | de Lioret | |
| 3,802,604 | A | 4/1974 | Morane et al. | |
| 3,924,741 | A | 12/1975 | Kachur et al. | |
| 3,968,872 | A | 7/1976 | Cavazza | |
| 4,024,952 | A | 5/1977 | Leitz | |
| 4,195,730 | A | 4/1980 | Hunt | |
| 4,221,291 | A | 9/1980 | Hunt | |
| 4,264,007 | A | 4/1981 | Hunt | |
| 4,638,927 | A * | 1/1987 | Morane | 222/83 |
| 4,648,532 | A | 3/1987 | Green | |
| 4,722,449 | A | 2/1988 | Dubach | |
| 4,785,931 | A * | 11/1988 | Weir et al. | 206/222 |
| 4,884,705 | A * | 12/1989 | Debetencourt | 222/519 |
| 5,114,011 | A | 5/1992 | Robbins, III | |
| 5,310,564 | A | 5/1994 | Kimm | |
| 5,543,097 | A | 8/1996 | Fang | |
| 5,772,017 | A | 6/1998 | Kang | |
| 5,788,369 | A | 8/1998 | Tseng | |
| 5,853,109 | A * | 12/1998 | Elliott | 222/83 |
| 5,884,759 | A | 3/1999 | Gueret | |
| 6,230,884 | B1 * | 5/2001 | Coory | 206/222 |
| 6,352,177 | B1 | 3/2002 | Bublewitz et al. | |
| 6,367,622 | B1 * | 4/2002 | Hsu | 206/222 |
| 6,477,743 | B1 * | 11/2002 | Gross et al. | 222/525 |
| 6,513,650 | B2 * | 2/2003 | Mollstam et al. | 206/222 |
| 6,609,612 | B2 * | 8/2003 | Vlodek | 206/222 |
| 6,679,375 | B1 * | 1/2004 | Coory | 206/219 |
| 6,715,646 | B2 * | 4/2004 | Suffa | 222/153.06 |
| 6,766,903 | B1 * | 7/2004 | Yehhsu | 206/222 |
| 6,772,910 | B1 * | 8/2004 | Coory | 222/83 |

* cited by examiner

*Primary Examiner*—Kenneth Bomberg
(74) *Attorney, Agent, or Firm*—Perry Hoffman

(57) ABSTRACT

The invention provides a dispense closure for a fluid receptacle. The closure includes a cap configured to engage the fluid receptacle threadably. The cap includes at least one aperture. The closure also includes a blister pack having at least one blister thereon. The blister contains an additive and is insertable through the aperture in the cap upon coupling the blister pack and cap. The closure further includes a retainer ring coupled to the cap. The retainer ring supports the blister pack in the cap and seals the cap and fluid receptacle together.

21 Claims, 9 Drawing Sheets

CLOSURE WITH SELECTIVELY OPERABLE DISPENSE FEATURE

RELATED APPLICATIONS

This is a continuation-in-part patent application of non-provisional U.S. patent application Ser. No. 10/003,158 filed on Oct. 31, 2001 now U.S. Pat. No. 6,609,612, which claims benefit of provisional U.S. Patent Application Ser. No. 60/244,934 filed on Nov. 1, 2000, all of which are incorporated herein by reference.

FIELD OF THE INVENTION

This invention relates generally to receptacle closures, and more particularly to such closures employed with beverage receptacles.

BACKGROUND OF THE INVENTION

Many kinds of beverage flavoring agents, mixes, and additives are commercially available in powdered, granulated, or solid forms. Such additives are typically packaged and sold separately from a solvent fluid such as water. There is, however, a penalty of inconvenience to the consumer since they must provide a suitable container when mixing the additive and solvent fluid, and measure and mix the additive with the solvent fluid before the mixed beverage is ready for consumption.

U.S. Pat. No. 4,785,931 (Weir et al.) discloses a molded plastic closure 2 having integral stacking support ribs 32 and rupturable mix compartments 14 containing a particulate drink mix 24. The rupturable mix compartments 14 are integrally formed with the closure 2. As a result, after all of the compartments 14 are depressed to dispense all of the drink mix 24, the entire closure 2 must be discarded and a new closure 2 including filled compartments 14 must be obtained. This is problematic in the sense that containers 4 may be provided in any number of different sizes having varying sizes of openings at their mouths. As a result, the closure 2 must be available in a wide variety of different sizes to accommodate the many different sizes of containers 4. As a result, overall manufacturing costs are likely to be increased.

Weir et al. also discloses that the closure 2 connects directly to the container 4 without any kind of seal therebetween. As a result, the flavored beverage 28 within the container 4 is likely to leak past the closure 4 upon pouring the beverage 28 from the container 4.

SUMMARY OF THE INVENTION

The present invention provides interactive packaging concepts that allow an end user to create their own beverage mix. Reaction of additives contained within a receptacle closure and a fluid component contained in a receptacle may be controlled and varied by a user. The additive may include use of colorants, flavors, and/or ingredients that move, change shape and color, and so forth, giving a visual value to the process of adding an additive to a fluid component just prior to consuming the mixed beverage. Also, the ability to add fresh, or time and light sensitive ingredients can be accomplished with the same dynamic. Such additive ingredients may include, e.g., powdered milk, baby formula, pharmaceuticals, or vitamins, minerals and nutrients, even fresh fruit flavor. The receptacle dispense closure may be used in combination with, but is not limited to: sports drinks, fruit juice, flavored milk, pudding, soups and candy/novelty. The closure may also be packaged and sold separately for additional use with reusable or disposable receptacles.

The present invention provides a dispense closure for a fluid receptacle. The closure includes a cap configured to threadably engage the fluid receptacle. The cap includes at least one aperture therethrough. The closure also includes a blister pack having at least one blister thereon. The blister contains an additive therein and is insertable through the aperture in the cap upon coupling the blister pack and cap. The closure further includes a retainer ring coupled to the cap. The retainer ring supports the blister pack in the cap and seals the cap and fluid receptacle together.

The present invention also provides a dispense closure for a fluid receptacle, the closure includes a cap configured to threadably engage the fluid receptacle. The cap includes at least one aperture therethrough. The closure also includes a blister pack having a blister thereon. The blister contains an additive therein and is insertable through the aperture in the cap upon coupling the blister pack and the cap. Further, the closure includes a bore seal extending from the cap and around the cap. The bore seal is configured to seal together the cap and the fluid receptacle.

Features and advantages of the present invention will become apparent to those skilled in the art upon review of the following detailed description, claims and drawings.

BRIEF DESCRIPTION OF THE DRAWINGS

In the drawings, wherein like reference numerals indicate like parts.

DETAILED DESCRIPTION

Figure 1:
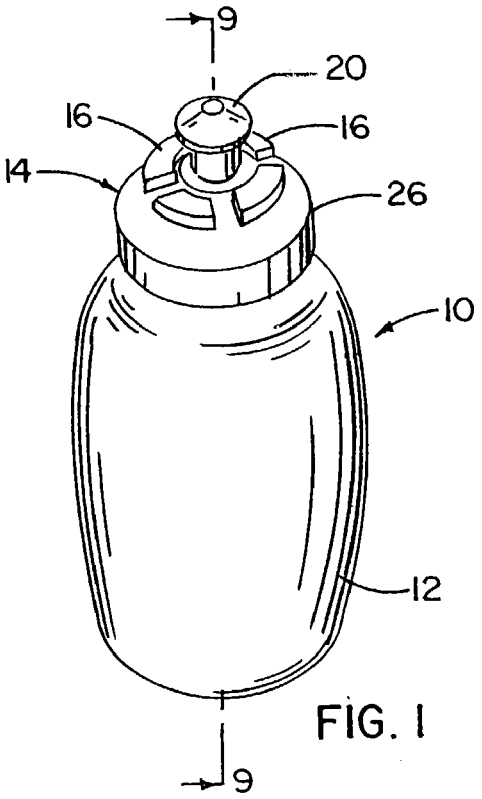
FIG. 1 is a perspective view of a beverage dispensing assembly.
Figure 2:
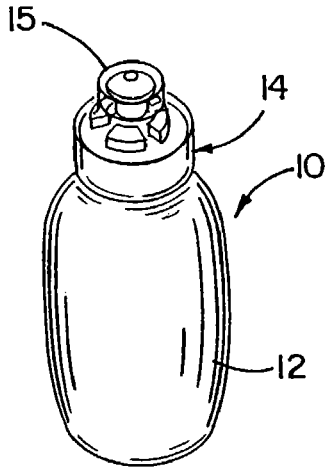
FIG. 2 is a perspective view of the beverage dispensing assembly of FIG. 1 with a protective cap applied.
Figure 3:
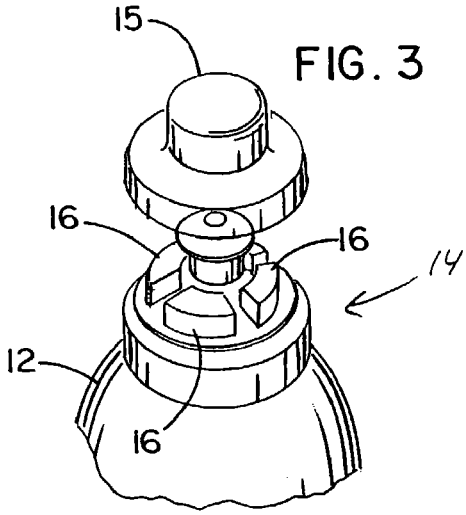
FIG. 3 is an exploded, partial perspective view of the beverage dispensing assembly of FIG. 2.
Figure 5:
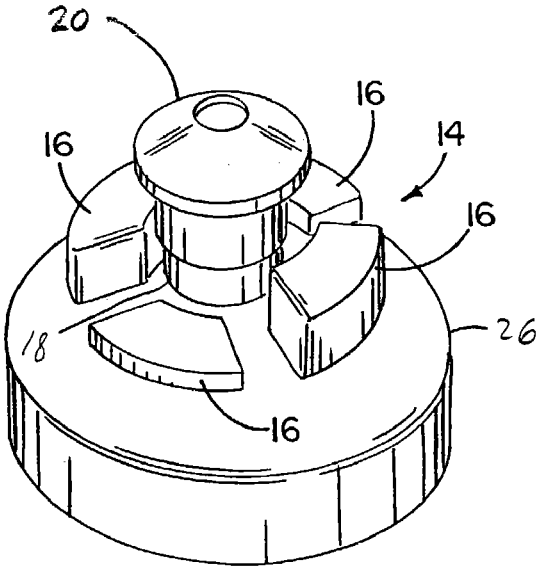
FIG. 5 is an enlarged, top-side perspective view of a closure of the beverage dispensing assembly of FIG. 1.
Figure 4:
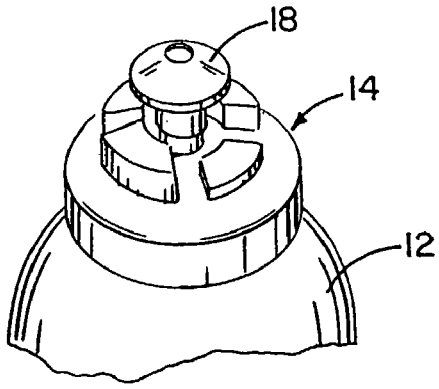
FIG. 4 is a partial perspective view of the beverage dispensing assembly of FIG. 1.
Figure 6:
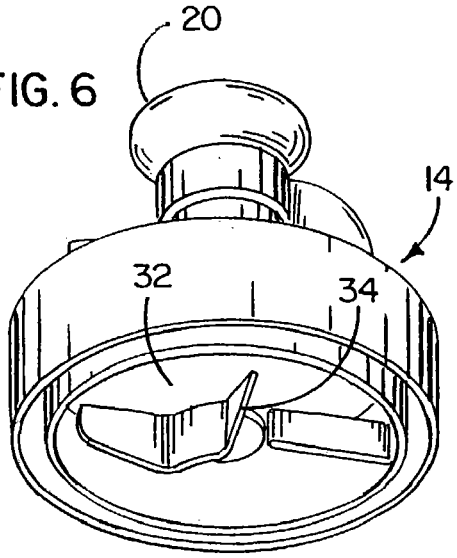
FIG. 6 is an enlarged, bottom-side perspective view of the closure of FIG. 5.
Figure 7:
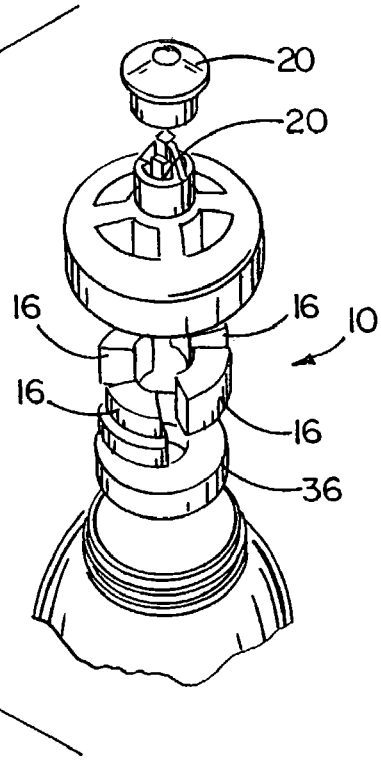
FIG. 7 is an exploded, top-side partial perspective view of the beverage dispensing assembly of FIG. 1.
Figure 8:
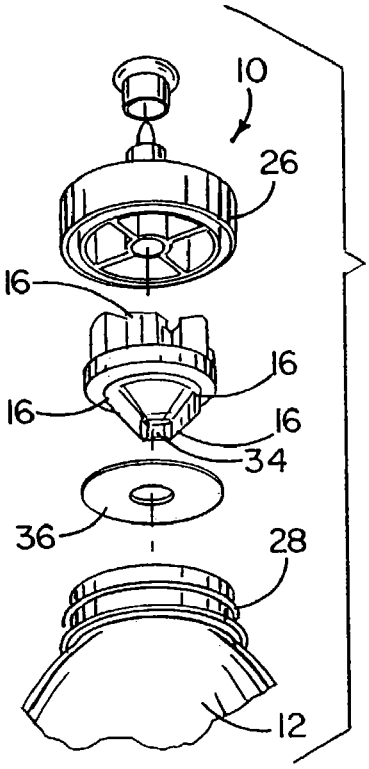
FIG. 8 is an exploded, bottom-side partial perspective view of the beverage dispensing assembly of FIG. 1.

Referring now to the drawings, a beverage dispensing assembly is generally indicated at 10. The beverage dispensing assembly 10 includes a receptacle 12 for containing a fluid component and a closure 14. As will be seen herein, the closure 14 is capable of selectively dispensing different additives to a fluid component (e.g., water) in the receptacle 12 to provide different batches of mixed beverage. Such additives may be configured for sweetening and/or coloring the fluid component in the receptacle 12. The closure 14 includes multiple plungers 16 disposed about a central valve member 18. A collar 20 is movable along the valve member 18 to open and close a valve passageway 22 (see FIG. 9). The closure 14 includes a threaded cap 26 for engagement with a threaded finish 28 of receptacle 12. A protective cap 15 couples to the cap 26 and covers the valve member 18 and plungers 16 so that the plungers 16 are not inadvertently depressed.

Figure 9:
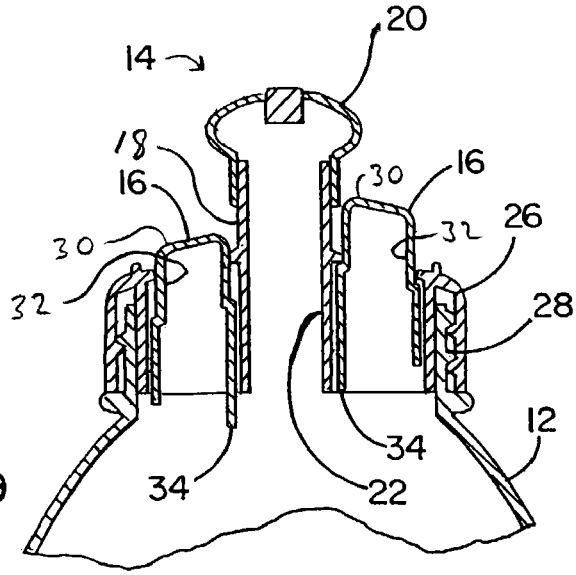
FIG. 9 is a partial cross-sectional view along the line 9—9 of the beverage dispensing assembly of FIG. 1.
Figure 10:
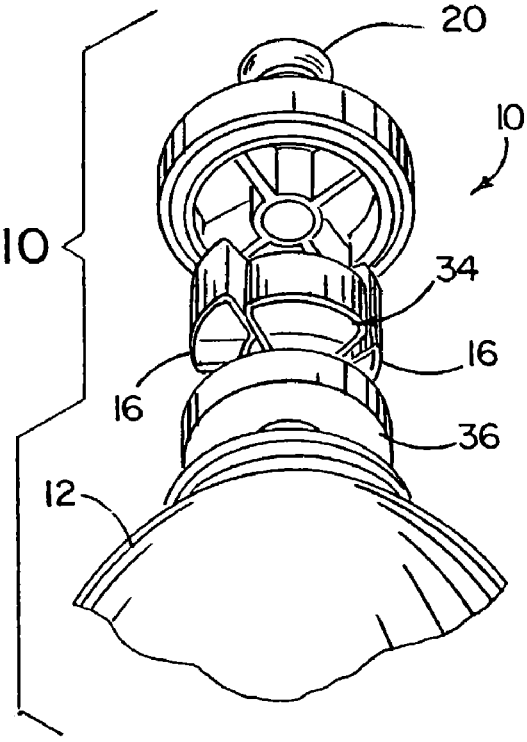
FIG. 10 is an exploded, bottom-side partial perspective view of the beverage dispensing assembly of FIG. 1.
Figure 11:
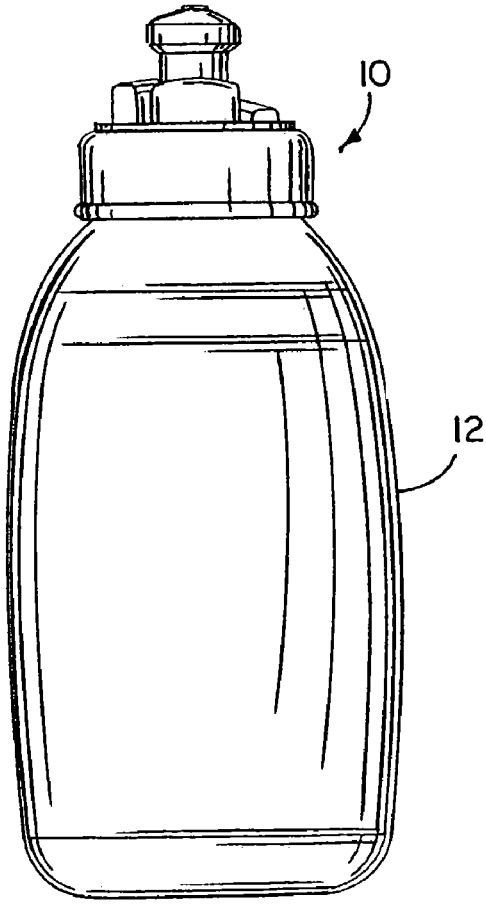
FIG. 11 is a side view of the beverage dispensing assembly of FIG. 1.
Figure 13:
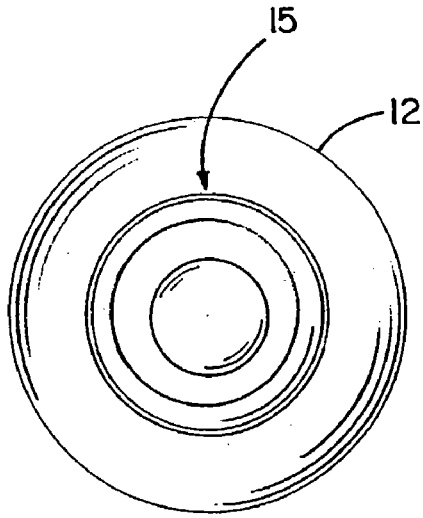
FIG. 13 is a top view of the beverage dispensing assembly and cover of FIG. 12.
Figure 12:
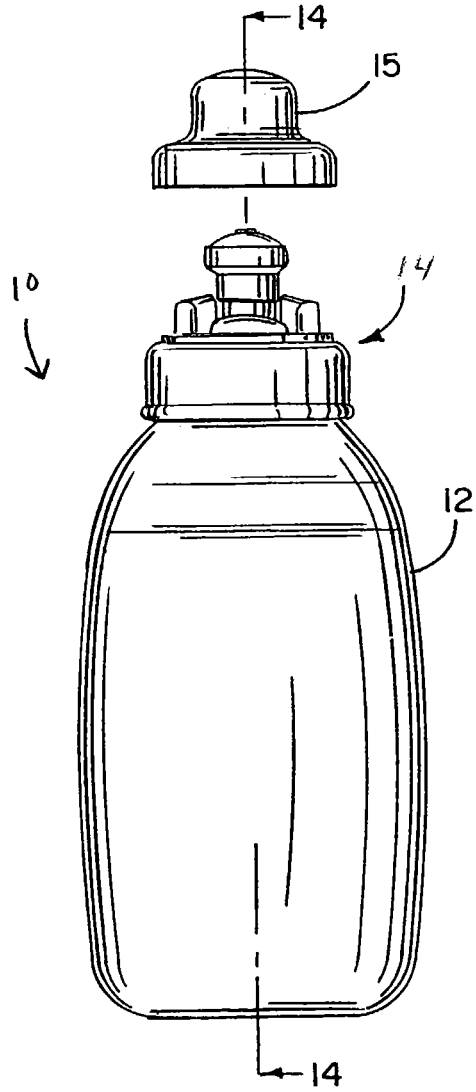
FIG. 12 is a side view of the beverage dispensing assembly of FIG. 1 with the protective cap.
Figure 14:
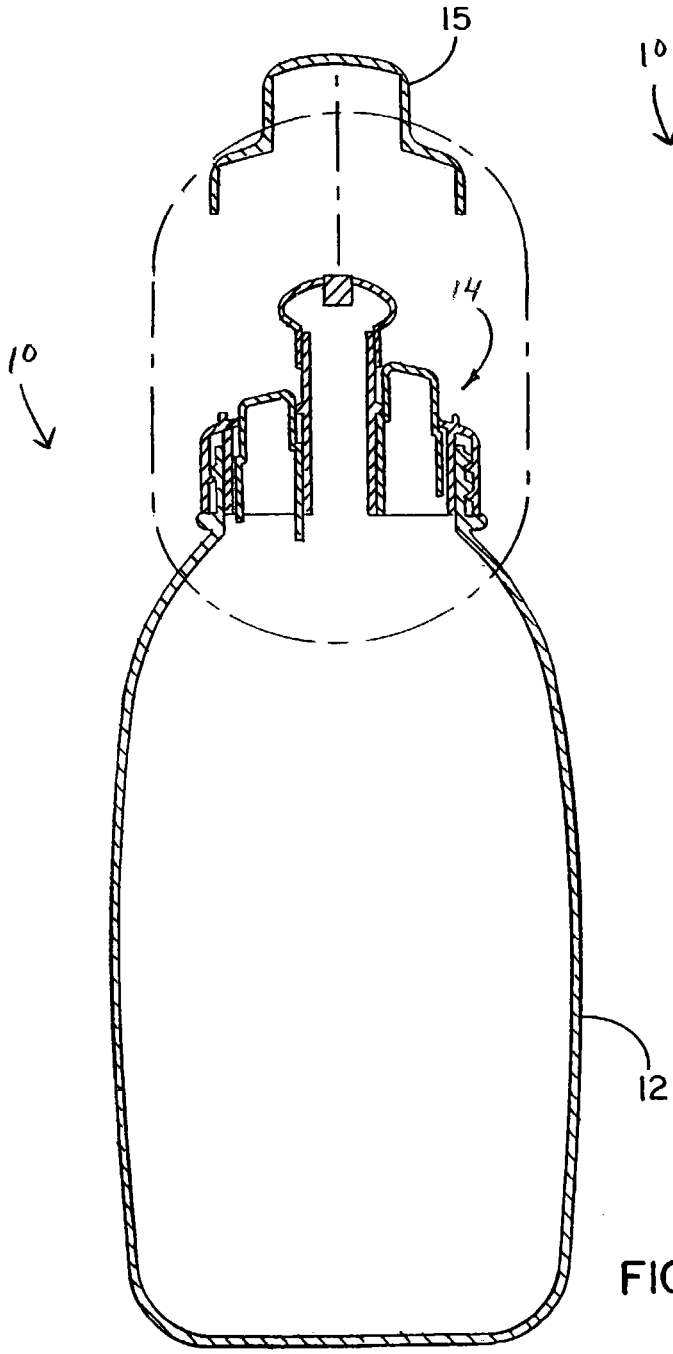
FIG. 14 is cross-sectional view of the beverage dispensing assembly and cover of FIG. 12 along line 14—14.

As shown in FIG. 9, the plungers 16 include an upper end 30 resembling a push button for actuation by a user. The plungers 16 also define a hollow interior cavity 32 containing an additive, and a lower end 34 for piercing a rupturable seal 36 affixed to the receptacle 12. When the plungers 16 are depressed by a user, the lower end 34 pierces and ruptures the seal 36, allowing the additive contained within the cavity 32 to spill into the receptacle 12.

As shown in the figures, four plungers 16 are provided in the closure 14. In one construction of the closure 14, each plunger 16 contains a different additive which, when mixed with the fluid component of the receptacle 12, produces a different flavored and/or colored beverage. Alternatively, each plunger 16 may contain a similar flavor additive rather than different flavor additives. Also, instead of a flavor additive, the additive contained within each plunger 16 and dispensed into the receptacle 12 may be a pharmaceutical, color additive, vitamin or mineral additive, candy, etc. After a first plunger 16 is depressed to pierce a first portion of the seal 36 to mix a first additive with the fluid component, and the resulting mixed beverage in the receptacle 12 is emptied, the receptacle 12 may be refilled with additional fluid component. A second plunger 18 may then be depressed to pierce a second portion of the seal 36 to mix a second additive with the fluid component of the receptacle 12 to produce a different mixed beverage. The receptacle 12 may then be subsequently refilled with additional fluid component after the mixed beverage is emptied, and different plungers are depressed until all the additives in the closure 14 have been dispensed.

Figure 15:
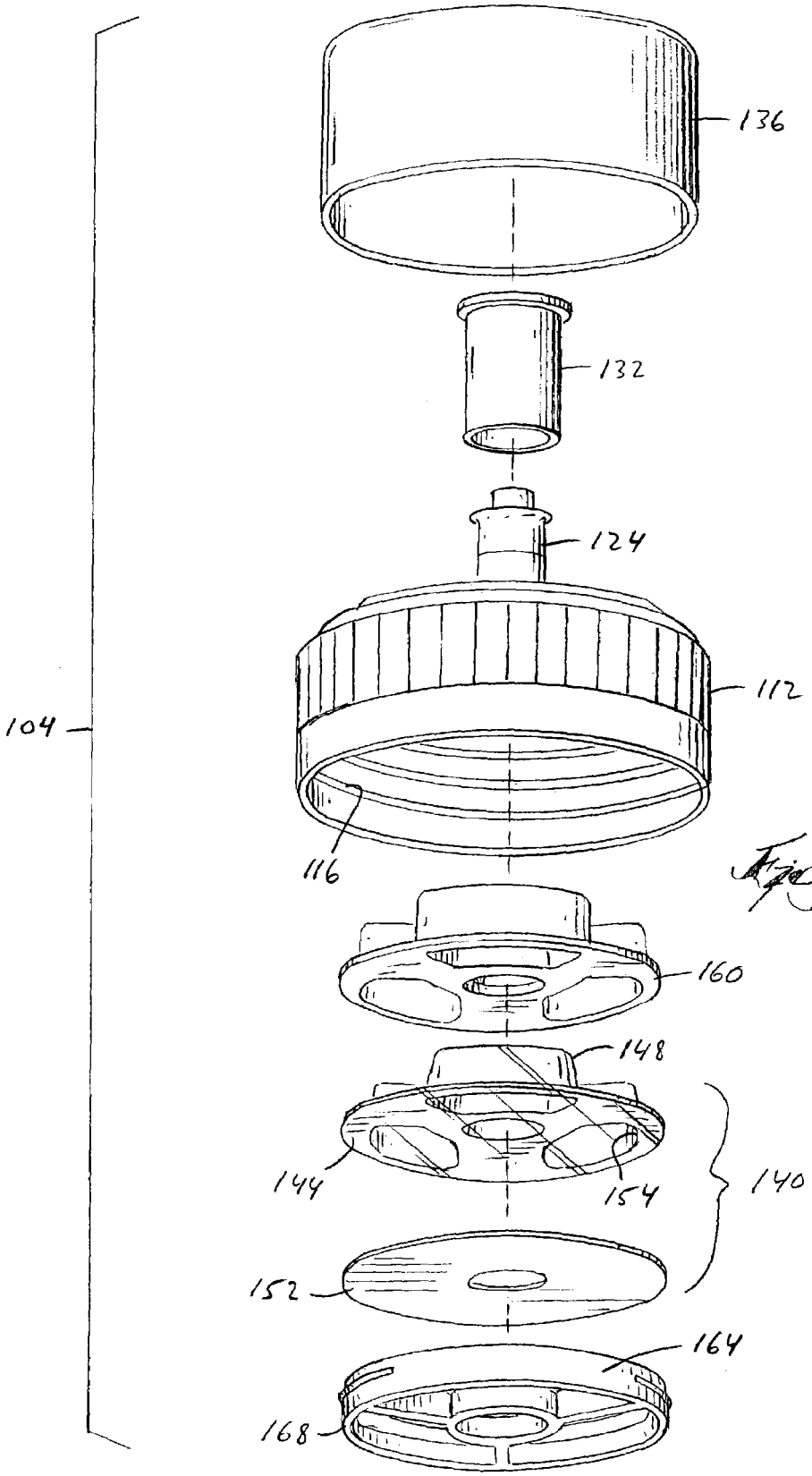
FIG. 15 is an exploded perspective view of another construction of a closure.
Figure 16:
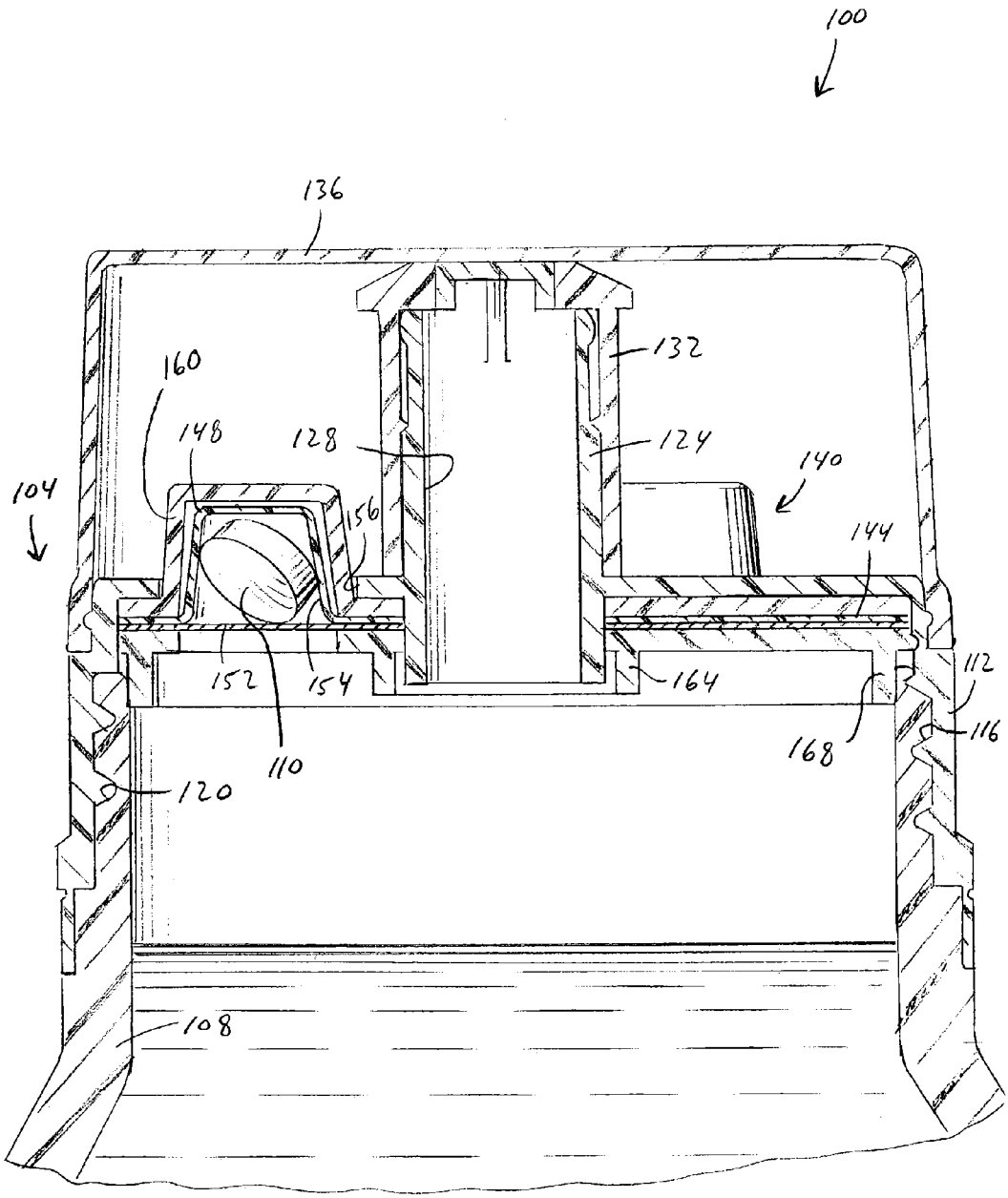
FIG. 16 is an assembled, partial cross-sectional view of the closure of FIG. 15 secured to a receptacle.

With reference to FIGS. 15–16, another construction of a beverage dispensing assembly 100 is shown. The assembly 100 includes a closure 104 coupled to a receptacle 108 containing a fluid component (e.g., water). The closure 104, similar to the closure 14 of FIGS. 1–14, is capable of selectively dispensing different additives 110 to the fluid component in the receptacle 108 to provide different batches of mixed beverages. The closure 104 includes a cap 112 having threads 116 formed therein for threaded engagement with a threaded finish 120 of the receptacle 108. Different caps 112 may be manufactured to match the available standard sizes of threaded finishes 120 for the receptacles 108. The cap 112 includes a central valve member 124 defining a valve passageway 128 therein for permitting fluid flow out of the receptacle 108. A collar 132 is movable along the valve member 124 to open and close the valve passageway 128.

With continued reference to FIGS. 15–16, a blister pack 140 including the multiple additives 110 is insertable into the cap 112. The blister pack 140 is comprised of a plastic annular disk 144 having multiple deformable raised portions, or blisters 148 therearound, and a rupturable seal 152 secured to the bottom of the disk 144 to cover cavities 154 formed by the blisters 148. The seal 152 is configured as a metal foil coated with a plastic layer (not shown). In the illustrated construction, the plastic layer of the seal 152 is bonded to the plastic disk 144 by a heat sealing process to ensure that the additives 110 in the blisters 148 are isolated. Such a heat sealing process may include, among others, conduction heating. The additives 110, shown in the illustrated construction as solid tablets, are contained within the cavities 154 by the seal 152. However, the additives 110 may also take other forms, such as, for example, a liquid or a granular powder. To release an additive 110 into the receptacle 108, a user would depress the associated blister 148, thereby causing the additive 110 to press against and rupture a portion of the seal 152 associated with that particular blister 148 after the additive 110 applies sufficient pressure to the seal 152.

The cap 112 includes multiple apertures 156 therethrough surrounding the central valve member 124. The apertures 156 are spaced in accordance with the number of blisters 148 on the blister pack 140, and sized to allow the blisters 148 to project through the apertures 156 and above the top surface of the cap 112. A seal membrane 160 is insertable between the blister pack 140 and the cap 112 to seal the blister pack 140 against the cap 112. The seal membrane 160 may be configured to be more or less rigid than the blisters 148. The closure 104 also includes a retainer ring 164 coupled to the cap 112 to secure the blister pack 140 in the cap 112. In the illustrated construction, the retainer ring 164 is configured to snap-fit into the cap 112. However, in other constructions of the closure (not shown), the retainer ring 164 may be heat sealed to the cap 112 rather than snap-fit.

The retainer ring 164 also includes a bore seal 168 extending therefrom, the bore seal 168 being positioned adjacent the threads 116 in the cap 112 (see FIG. 16) upon assembling the closure 104 and the receptacle 108. Upon threading the cap 112 onto the threaded finish 120 of the receptacle 108, the threaded finish 120 is compressed between the bore seal 168 and the cap 112 to seal the fluid component or the mixed beverage contained in the receptacle 108.

The cap 112, seal membrane 160, annular disk 144, and the retainer ring 164 are formed from a plastic material. Preferably, polypropylene is used for the plastic material, however, other plastic materials with like properties may be substituted.

Figure 17:
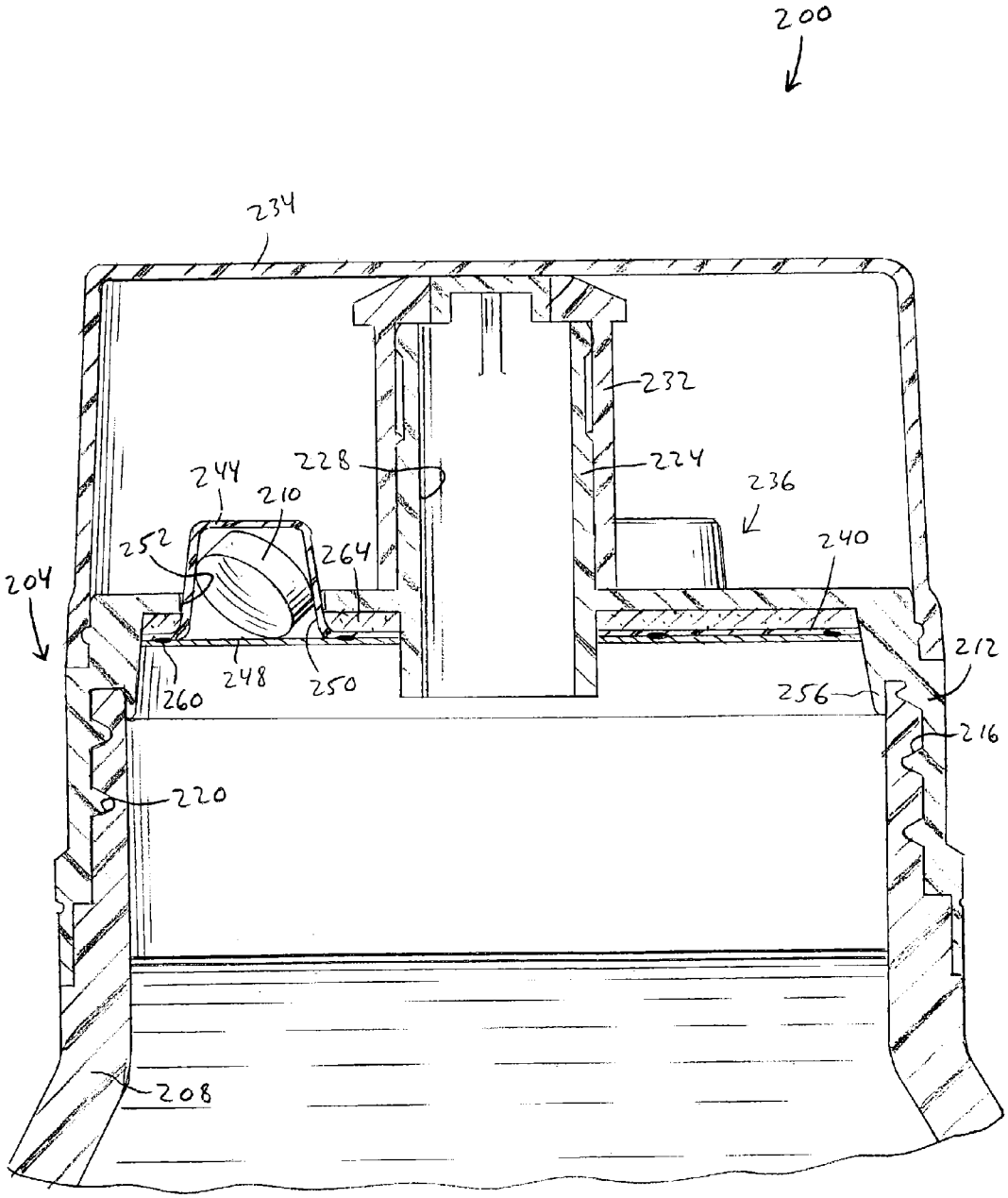
FIG. 17 is an assembled, partial cross-sectional view of yet another construction of a closure secured to a receptacle.

With reference to FIG. 17, another construction of a beverage dispensing assembly 200 is shown. The assembly 200 includes a closure 204 coupled to a receptacle 208 containing a fluid component (e.g., water). The closure 204, similar to the closure 14 of FIGS. 1–14 and the closure 104 of FIGS. 15–16, is capable of selectively dispensing different additives 210 to the fluid component in the receptacle 208 to provide different batches of mixed beverages. The closure 204 includes a cap 212 having threads 216 formed therein for threaded engagement with a threaded finish 220 of the receptacle 208. Different caps 212 may be manufactured to match the available standard sizes of threaded finishes 220 for receptacles 208. The cap 212 includes a central valve member 224 defining a valve passageway 228 therein for permitting fluid flow out of the receptacle 208. A collar 232 is movable along the valve member 224 to open and close the valve passageway 228. A protective cap 234 may couple to the cap 212 and cover the valve member 224 and collar 232.

With continued reference to FIG. 17, a blister pack 236 including the multiple additives 210 is insertable into the cap 212. The blister pack 236 is comprised of an annular disk 240 having multiple raised portions, or blisters 244 therearound, and a rupturable seal 248 secured to the bottom of the disk 240 to cover cavities 250 formed by the blisters 244. The seal 248 is configured as a metal foil coated with a plastic layer (not shown). In the illustrated construction, the plastic layer of the seal 248 is bonded to the disk 240 by a heat sealing process to ensure that the additives 210 in the blisters 244 are isolated. Such a heat sealing process may include, among others, conduction heating. The additives 210, shown in the illustrated construction as solid tablets, are contained within the cavities 250 by the seal 248. However, the additives 210 may also take other forms, such as, for example, a liquid or a granular powder. To release an additive 210 into the receptacle 208, a user would depress the associated blister 244, thereby causing the additive 210 to press against and rupture a portion of the seal 248 associated with that particular blister 244 after the additive 210 applies sufficient pressure to the seal 248.

The cap 212 includes multiple apertures 252 therethrough surrounding the central valve member 224. The apertures 252 are spaced in accordance with the number of blisters 244 on the blister pack 236, and sized to allow the blisters 244 to project through the apertures 252 and above the top surface of the cap 212. The cap 212 also includes a bore seal 256 extending therefrom, the bore seal 256 being positioned adjacent the threads 216 in the cap 212 (see FIG. 17). Upon threading the cap 212 onto the threaded finish 220 of the receptacle 208, the threaded finish 220 is compressed between the bore seal 256 and the cap 212 to seal the fluid component or the mixed beverage contained in the receptacle 208.

A heat sealing process is utilized to secure the blister pack 236 to the cap 212. Such a heat sealing process may include, among others, induction sealing or sonic welding. In the case of using induction sealing, an electromagnetic field is applied to the assembled closure 204. The electromagnetic field causes the metal foil of the seal 248 to heat up. Further, the heat causes the plastic annular disk 240 and the plastic cap 212 to melt together and form a bond 264. The annular disk 240 and cap 212 are preferably formed from polypropylene, however, other plastic materials with like properties may be substituted.

Figure 18:
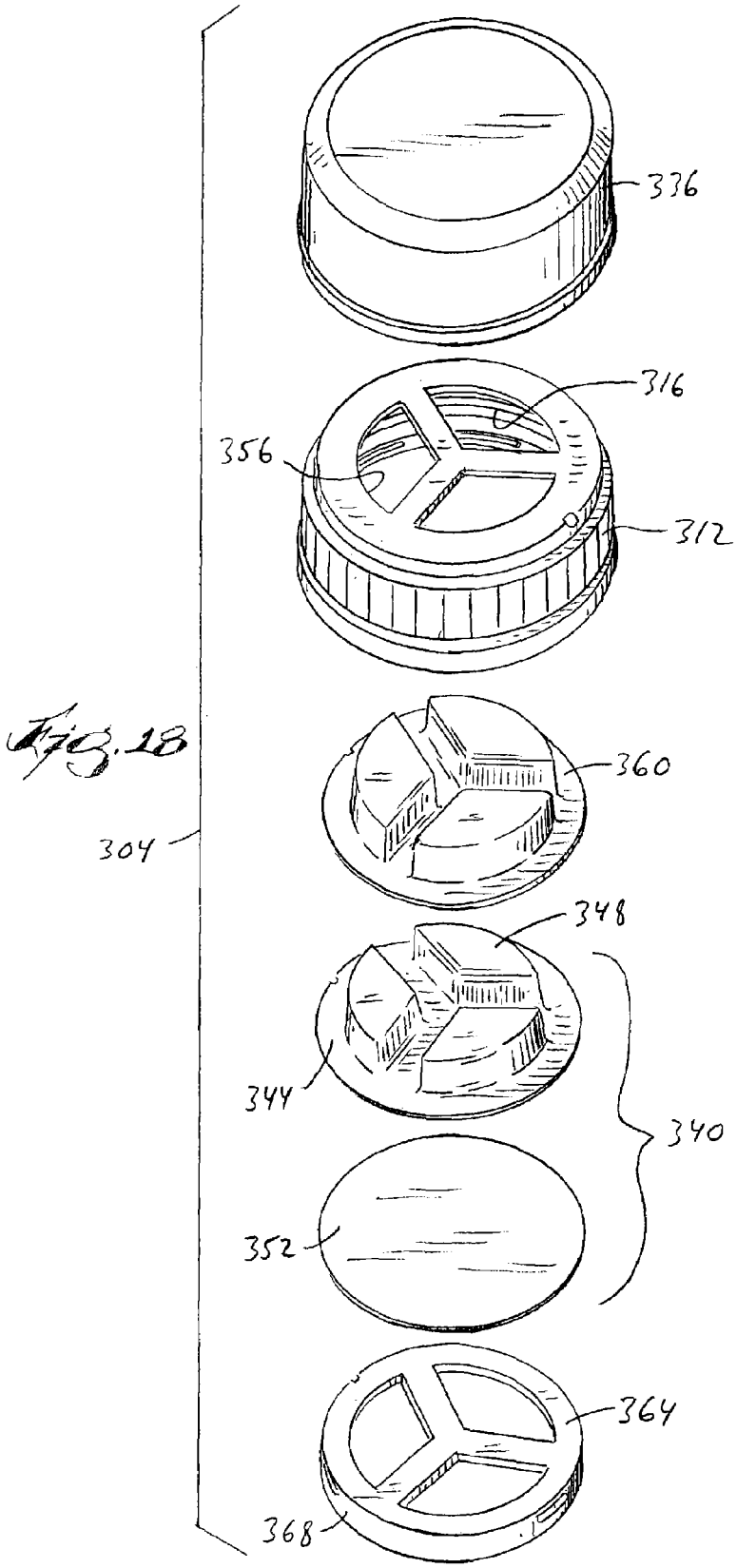
FIG. 18 is an exploded perspective view of another construction of a closure.
Figure 19:
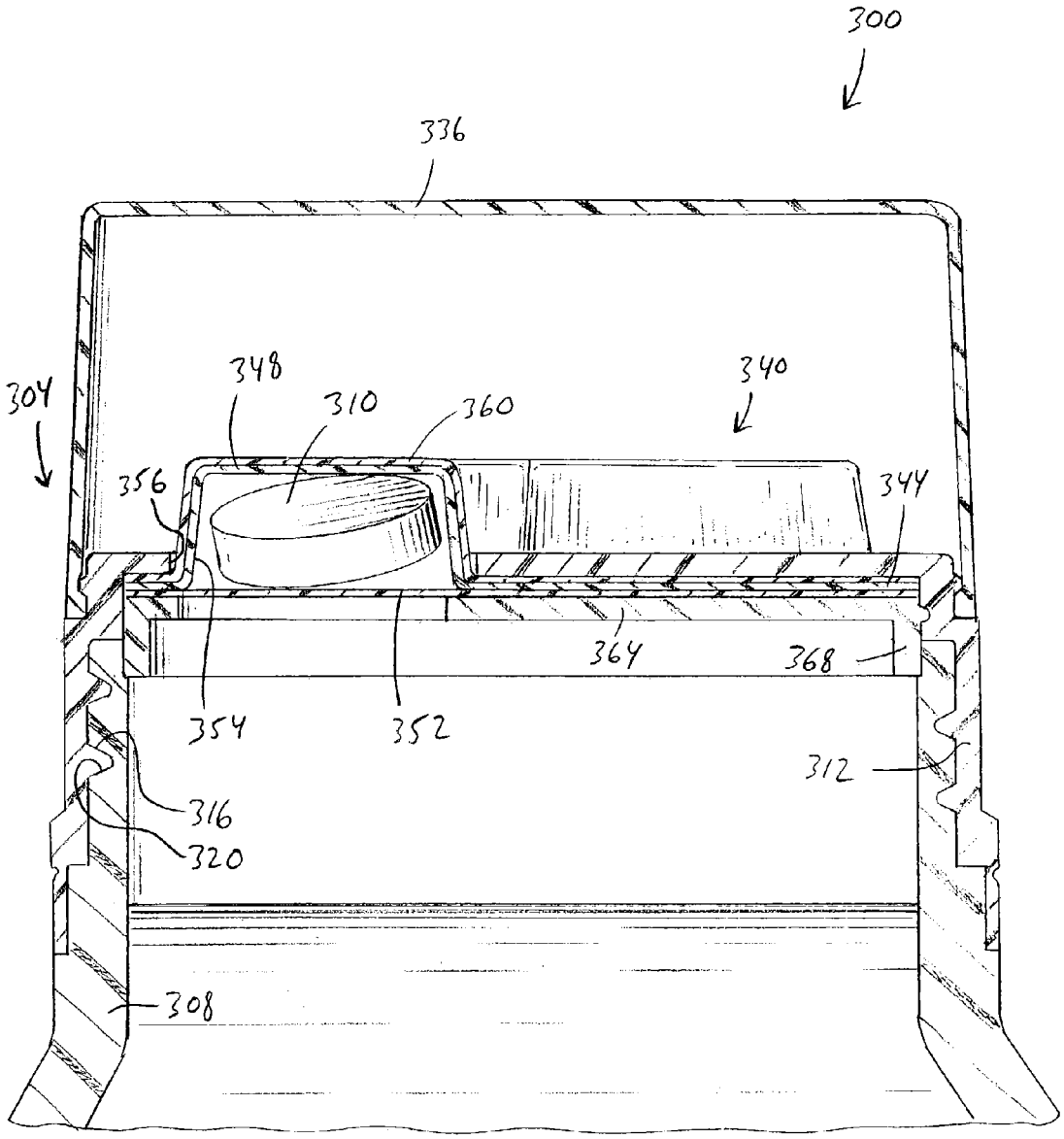
FIG. 19 is an assembled, partial cross-sectional view the closure of FIG. 18 secured to a receptacle.

With reference to FIGS. 18–19, yet another construction of a beverage dispensing assembly 300 is shown. The assembly 300 includes a closure 304 coupled to a receptacle 308 containing the fluid component (e.g., water). The closure 304, similar to the closures 14, 104, 204 of FIGS. 1–17, is capable of selectively dispensing different additives 310 to the fluid component in the receptacle 308 to provide different batches of mixed beverages. The closure 304 includes a cap 312 having threads 316 formed therein for threaded engagement with a threaded finish 320 of the receptacle 308. Different caps 312 may be manufactured to match the available standard sizes of threaded finishes 320 for the receptacles 308.

With continued reference to FIGS. 18–19, a blister pack 340 including multiple additives 310 is insertable into the cap 312. The blister pack 340 is comprised of a plastic annular disk 344 having multiple deformable raised portions, or blisters 348 therearound, and a rupturable seal 352 secured to the bottom of the disk 344 to cover cavities 354 formed by the blisters 348. The seal 352 is configured as a metal foil coated with a plastic layer (not shown). In the illustrated construction, the plastic layer of the seal 352 is bonded to the plastic disk 344 by a heat sealing process to ensure that the additives 310 in the blisters 348 are isolated. Such a heat sealing process may include, among others, conduction heating. The additives 310, shown in the illustrated construction as solid tablets, are contained within the cavities 354 by the seal 352. However, the additives 310 may also take other forms, such as, for example, a liquid or a granular powder. To release an additive 310 into the receptacle 308, a user would depress the associated blister 348, thereby causing the additive 310 to press against and rupture a portion of the seal 352 associated with that particular blister 348 after the additive 310 applies sufficient pressure to the seal 352.

The cap 312 includes multiple apertures 356 therethrough. The apertures 356 are spaced in accordance with the number of blisters 348 on the blister pack 340, and sized to allow the blisters 348 to project through the apertures 356 and above the top surface of the cap 312. A seal membrane 360 is insertable between the blister pack 340 and the cap 312 to seal the blister pack 340 against the cap 312. The seal membrane 360 may be configured to be more or less rigid than the blisters 348. The closure 304 also includes a retainer ring 364 coupled to the cap 312 to secure the blister pack 340 in the cap 312. In the illustrated construction, the retainer ring 364 is configured to snap-fit into the cap 312. However, in other constructions of the closure (not shown), the retainer ring 364 may be heat sealed to the cap 312 rather than snap-fit.

The retainer ring 364 also includes a bore seal 368 extending therefrom, the bore seal 368 being positioned adjacent the threads 316 in the cap 312 (see FIG. 19) upon assembling the closure 304 and the receptacle 308. Upon threading the cap 312 onto the threaded finish 320 of the receptacle 308, the threaded finish 320 is compressed between the bore seal 368 and the cap 312 to seal the fluid component or the mixed beverage contained in the receptacle 308.

A protective cap 336 may also couple to the cap 312 and cover the blisters 348 so that the blisters are not inadvertently depressed.

The cap 312, seal membrane 360, annular disk 344, and the retainer ring 364 are formed from a plastic material. Preferably, polypropylene is used for the plastic material, however, other plastic materials with like properties may be substituted.

The various closures 14, 104, 204, 304 disclosed herein provide interactive packaging concepts that allow the end user to create their own beverage mix. Reaction of the additives and the fluid component in the receptacles 12, 108, 208, 308 may be varied to include animated use of additives, colorants, flavors, and/or ingredients that move, change shape and color, and so forth, thus giving a visual value to the process of adding an additive to a fluid component just prior to consuming the mixed beverage.

Also, the ability to add fresh, or time and light sensitive ingredients can be accomplished with the same dynamic, e.g., powdered milk, baby formula, pharmaceuticals, or vitamins, minerals and nutrients, even fresh fruit flavor. The closures 14, 104, 204, 304 may be used with in combination with, but not limited to: sports drinks, fruit juice, flavored milk, pudding, soups and candy/novelty. The closures 14,

104, 204, 304 may also be packaged and sold separately for additional use with reusable receptacles 12, 108, 208, 308.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

I claim:

1. A dispense closure for a fluid receptacle, the closure comprising:

a cap configured to engage the fluid receptacle threadably, the cap including at least one aperture therethrough;

a blister pack including at least one deformable blister thereon, the blister containing an additive therein, the blister being insertable through the aperture in the cap upon coupling the blister pack and cap; and a retainer ring coupled to the cap, the retainer ring supporting the blister pack in the cap and sealing the cap and fluid receptacle together.

2. The closure of claim 1, further comprising a valve coupled to the cap, the valve being configured between an open position for dispensing fluid from the receptacle and a closed position.

3. The closure of claim 1, wherein the retainer ring is coupled to the cap via a snap-fit.

4. The closure of claim 1, wherein the retainer ring is heat sealed to the cap.

5. The closure of claim 1, further comprising a collar coupled to the valve, wherein the collar is selectively manipulatable to open and close the valve.

6. The closure of claim 1, wherein the blister pack includes:

a substantially-annular disk made from a plastic material having a raised portion defined on one side of the disk and a cavity on an opposite side of the disk corresponding with the raised portion, the raised portion defining the blister; and a rupturable seal coupled to the side of the disk having the cavity, by which the cavity is covered.

7. The closure of claim 6, wherein the additive is contained within the cavity, and wherein the additive is secured in the cavity by the rupturable seal.

8. The closure of claim 6, wherein the disk is made from a plastic material, wherein the rupturable seal is made from a metal foil material having a coated layer of plastic material, and wherein the rupturable seal is heat sealed to the disk.

9. The closure of claim 1, wherein the retainer ring includes at least one aperture therethrough, the aperture of the retainer ring being alignable with the aperture of the cap.

10. The closure of claim 1, wherein the retainer ring includes a bore seal extending from the ring and around the ring, and wherein the bore seal is positioned adjacent to threads formed in the cap upon coupling with the cap.

11. The closure of claim 10, wherein the fluid receptacle is compressed between the bore seal and the cap upon engaging the cap and fluid receptacle.

12. The closure of claim 1, further comprising a membrane configured to cover the blister, the membrane being positioned between the cap and the blister pack.

13. The closure of claim 12, wherein the membrane is made from a plastic material.

14. A dispense closure for a fluid receptacle, the closure comprising:

a cap configured to engage the fluid receptacle threadably, the cap including at least one aperture therethrough;

a blister pack including a deformable blister thereon, the blister containing an additive therein and the blister being insertable through the aperture in the cap upon coupling the blister pack and the cap; and a bore seal extending from the cap and around the cap, the bore seal being configured to seal together the cap and the fluid receptacle.

15. The closure of claim 14, further comprising a valve coupled to the cap, the valve being configured between an open position for dispensing fluid from the receptacle and a closed position.

16. The closure of claim 14, further comprising a collar coupled to the valve, wherein the collar is selectively manipulatable to open and close the valve.

17. The closure of claim 14, wherein the blister pack includes:

a substantially-annular disk made from a plastic material having a raised portion defined on one side of the disk and a cavity on an opposite side of the disk corresponding with the raised portion, the raised portion defining the blister; and a rupturable seal coupled to the side of the disk having the cavity, the rupturable seal covering the cavity.

18. The closure of claim 17, wherein the disk is made from a plastic material, wherein the rupturable seal is made from a metal foil material having a coated layer of plastic material, and wherein the rupturable seal is heat sealed to the disk.

19. The closure of claim 18, wherein the cap is made from a plastic material, and wherein the cap and disk are joined via a heat sealing process.

20. The closure of claim 17, wherein the additive is contained within the cavity, and wherein the additive is secured in the cavity by the rupturable seal.

21. The closure of claim 14, wherein the bore seal is positioned adjacent to threads formed in the cap, and wherein the fluid receptacle is compressed between the bore seal and the cap upon engaging the cap and fluid receptacle.

* * * * *